US012674651B2

(12) United States Patent
Eichhorn et al.

(10) Patent No.: US 12,674,651 B2
(45) Date of Patent: Jul. 7, 2026

(54) ARRANGEMENT AND METHOD FOR INCREASING THE FUNCTIONAL SAFETY OF AN OPTO-PYROTECHNIC INITIATOR

(71) Applicant: Fraunhofer-Gesellschaft zur Förderung der angewandten Forschung e.V., Munich (DE)

(72) Inventors: Marc Eichhorn, Ettlingen (DE); Christelle Kieleck, Ettlingen (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 18/684,303

(22) PCT Filed: Aug. 18, 2022

(86) PCT No.: PCT/EP2022/073066
§ 371 (c)(1),
(2) Date: Feb. 16, 2024

(87) PCT Pub. No.: WO2023/021135
PCT Pub. Date: Feb. 23, 2023

(65) Prior Publication Data

US 2024/0247918 A1 Jul. 25, 2024

(30) Foreign Application Priority Data

Aug. 19, 2021 (DE) ..... 10 2021 121 536.6

(51) Int. Cl.
*F42B 3/113* (2006.01)

(52) U.S. Cl.
CPC ..... *F42B 3/113* (2013.01)

(58) Field of Classification Search
CPC ..... F42B 3/113; F42C 13/02; F42C 13/026; F42C 15/00; F42C 99/00
See application file for complete search history.

(56) References Cited

U.S. PATENT DOCUMENTS 3,177,651 A 4/1965 Lawrence
4,660,472 A * 4/1987 Stevens ..... F42C 15/34 102/275.12

(Continued)

FOREIGN PATENT DOCUMENTS

DE 3904276 C2 2/1998
DE 19958925 A1 * 1/2001 ..... B60R 21/01

(Continued)

OTHER PUBLICATIONS

International Search Report and Written Opinion mailed on Dec. 5, 2022, received for International Patent Application No. PCT/EP2022/073066, filed on Aug. 18, 2022, 10 pages including English Translation.

*Primary Examiner* — Bret Hayes
(74) *Attorney, Agent, or Firm* — XSENSUS LLP

(57) ABSTRACT

An arrangement has an opto-pyrotechnic initiator, at least one laser, and an optical fibre, via which the laser radiation of the laser is guided to the opto-pyrotechnic initiator. Also disclosed is a method for improving the safety of such an opto-pyrotechnic initiator. At least one optical filter element having power-dependent or intensity-dependent transmission or reflection is arranged in the beam path of the laser radiation between the laser and the initiating impingement location of the laser radiation in the initiator. The filter element and the beam guidance for the laser radiation are selected such that for a laser power of the laser, that is intended to effect an initiation, the filter element has a higher transmission or reflection or can be switched to a higher transmission or reflection than for a lower laser power by (Continued)

application of an optical or electronic signal that is independent of the laser radiation.

14 Claims, 4 Drawing Sheets

(56) References Cited

U.S. PATENT DOCUMENTS

| | | | | | |
|---|---|---|---|---|---|
| 4,862,802 | A * | 9/1989 | Streifer | F42B 3/113 102/201 |
| 4,917,014 | A | 4/1990 | Loughry et al. | |
| 5,036,767 | A * | 8/1991 | Folsom | F42B 3/113 102/201 |
| 5,206,455 | A * | 4/1993 | Williams | F42C 21/00 102/201 |
| 5,359,192 | A | 10/1994 | Williams et al. | |
| 5,965,877 | A | 10/1999 | Wood et al. | |
| 6,227,114 | B1 | 5/2001 | Wu et al. | |
| 2005/0183605 | A1 * | 8/2005 | Bishop | F42C 15/18 102/201 |
| 2018/0119530 | A1 * | 5/2018 | Skinner | E21B 43/1185 |

FOREIGN PATENT DOCUMENTS

| | | | | |
|---|---|---|---|---|
| GB | 2267330 | A * | 12/1993 | C06B 45/12 |
| RU | 2691381 | C1 | 6/2019 | |
| WO | 2016/209259 | A1 | 12/2016 | |

* cited by examiner

ARRANGEMENT AND METHOD FOR INCREASING THE FUNCTIONAL SAFETY OF AN OPTO-PYROTECHNIC INITIATOR

CROSS-REFERENCE TO RELATED APPLICATIONS

This application is a national stage application, pursuant to 35 U.S.C. § 371, of International Patent Application No. PCT/EP2022/073066, filed Aug. 18, 2022, which claims priority from German Patent Application No. 10 2021 121 536.6, filed Aug. 19, 2021, the entire contents of each are incorporated herein by reference.

TECHNICAL APPLICATION FIELD

The present invention relates to an arrangement having an opto-pyrotechnic initiator, in which a pyrotechnic mixture can be ignited by the action of laser radiation, at least one laser, which emits the laser radiation, and an optical fibre, via which the laser radiation is guided to the opto-pyrotechnic initiator. The invention also relates to a method for improving the functional safety of an opto-pyrotechnic initiator of such kind.

In blasting and pyrotechnics technology, the functional safety of initiators (detonators) is of enormous importance. In this context, one special, more recent initiator type is the opto-pyrotechnic initiator, in which a pyrotechnic mixture, in particular an explosive, is ignited or initiated by the optical effect of laser. Due to the purely optical connection of the pyrotechnic initiator via an optical fibre to a laser, typically in the form of a laser diode, this initiator type has significant potential for use in critical, in some cases even electromagnetically sensitive application areas, since it does not rely on an electrical connection to the ignition electronics, but is connected instead via an insulating optical fibre. For many applications, however, the functional safety provided by the control of the laser alone is not sufficient, and it is therefore imperative to implement a second, independent safety mechanism.

PRIOR ART

Until now, opto-pyrotechnic initiators have not been used widely in either civilian or military applications. As a rule, prior initiator technology has more often been based on electrical initiators. In such cases, use is frequently made of mechanical elements to break the ignition chain appropriately, to prevent unintentional initiation. Corresponding mechanical elements can also be used to interrupt the ignition chain appropriately in the optical domain in the case of opto-pyrotechnic initiators. For example, B. Chamayou in "Opto-Pyro Trains for Space Systems—Gains Provided by Opto-Pyro Technology in Terms of Safety on Launchers", Journal of Space Safety Engineering, Vol. 1, No. 2, December 2014, pages 61 to 74 presents an example of an arrangement with opto-pyrotechnic initiator, in which a mechanical element of such kind is used. However, mechanical elements for blocking or clearing an optical path are slow, as mechanical parts have to be moved.

The problem addressed by the present invention is that of describing a method and an arrangement for an opto-pyrotechnic initiator, with which the functional safety of the opto-pyrotechnic initiator may be increased and resulting in only insignificant delay in initiation.

DESCRIPTION OF THE INVENTION

The problem is solved with the arrangement and the method according to Claims 1 and 13. Advantageous variations of the arrangement and the method are the object of the dependent claims or may be discerned from the following description and embodiments.

The suggested arrangement has an opto-pyrotechnic initiator, in which a pyrotechnic mixture can be ignited by the action of laser radiation, and at least one laser and (at least) one optical fibre, via which the laser radiation emitted from the laser is guided to the opto-pyrotechnic initiator. One or more laser diodes are preferably used as lasers. The arrangement is characterized in that an optical filter element having power-dependent or intensity-dependent transmission or reflection is arranged in the beam path of the laser radiation between the laser and an initiating impingement location of the laser radiation in the opto-pyrotechnic initiator. The optical filter element preferably has a non-linear (power-dependent or intensity-dependent) transmission or reflection function for the laser radiation. This behaviour may have been specified in advance according to the material, it may be able to be influenced externally, or it may be influenced additionally by the laser radiation itself. The filter element and the beam guide of the laser radiation through or via the filter element are selected such that in the case of a laser power of the laser intended to trigger an initiation in the opto-pyrotechnic initiator in the arrangement, the filter element has a higher transmission or reflection, or may be switched to a higher transmission or reflection by the application of a further optical or electrical signal than in the case of a lower laser power. The present method is thus based on the use of at least one optical filter element, which has a power-dependent or intensity-dependent transmission or reflection, and which is introduced into the optical path between the laser and the initiating impingement location of the laser radiation in the initiator.

A second, independent mechanism is provided by the power-dependent or intensity-dependent transmission or reflection function of this filter element, and this mechanism limits the working range of the laser needed for initiation and/or the power of the laser radiation emitted by the laser needed for initiation towards high laser powers. At these high laser powers, with which an intended initiation of the pyrotechnic mixture in the initiator is achieved, the filter element has a high transmission and/or reflection, at lower laser powers, the transmission and/or reflection is significantly less. In this way, it is assured that unintended operation for example of a laser diode functioning as a laser with moderate output, such as may occur in the case of a faulty driver switch (transistor, IGBT, MosFET), does not result in the initiation of the pyrotechnic mixture due to prolonged heating, since the laser radiation of this low laser power is substantially weakened or completely blocked and/or absorbed by the filter element. Such unintended behaviour might be caused for example by electromagnetic radiation or material defects in the actuation technology of the laser.

In a particular embodiment, the dependency of the transmission or reflection of the optical filter element on power or intensity is influenced by a further optical or electronic signal, also referred to in the following text as external signal. In such a case, it is particularly advantageous if the dependency on power or intensity increases the required laser power needed for initiation without application of an external signal, thus increasing the level of safety. An intentional initiation of the pyrotechnic mixture in the initiator may then be effected for example in a non-linear filter material by a second laser source, which illuminates the filter material in such a way that its optical output lowers the switching threshold of the filter, preferably without impinging on the ignition surface. This second laser source may have a wavelength that is either comparable to the first laser source, which delivers the initiation power, or a different wavelength. If semiconductors or readily electrically conductive crystals are used as filter materials, these properties may also be varied for this purpose by the application of additional electrical current, for example.

Various options may be considered as the design for the suggested optical filter. Thus, the optical filter element may be formed for example by a saturable absorber, which only becomes saturated above a certain intensity threshold, i.e. has a high transmittance. The beam guide through this absorber is then selected such that this intensity threshold is not exceeded until a laser power is reached in the arrangement at which an intended initiation of the pyrotechnic mixture takes place in the initiator. In a further design, the optical filter element is formed by a combination of a non-linear medium which has power-dependent or intensity-dependent focusing or defocusing properties, and a shutter positioned after it in the beam path, which allows the laser radiation to pass unobstructed only when focusing by means of the non-linear medium. A further design of the suggested optical filter element consists of a thin-film reflector, in which the thin-film medium performs a phase transition under the effect of heat, which causes the reflectivity or transmission for the laser radiation to change. This thermal effect may be intrinsic, that is to say generated by the laser radiation itself, or extrinsic, caused by an additional electrical current, for example. The latter case offers the advantage that the light signal and the filter are totally separated, allowing the creation of two completely independent safety circuits. Also, a combination of the intrinsic and extrinsic effects to achieve a corresponding change in the transmission is advantageous.

In principle, the optical filter element may be arranged anywhere in the beam path of the laser radiation between the laser and the initiating impingement location of the laser radiation in the pyrotechnic initiator. Accordingly, the filter element may be implemented as early as inside the laser housing, between the laser housing and the optical fibre, between the optical fibre and the opto-pyrotechnic initiator, or also inside the opto-pyrotechnic initiator. It is even possible to fit the optical filter element in the optical fibre, optionally with an additional optical arrangement for focusing the laser radiation on the filter element. The filter element is particularly advantageously positioned inside the laser housing or between laser or laser housing and optical fibre, since this ensures that in the event of a malfunction the thermal load is kept away from the initiator and/or the pyrotechnic mixture thereof. This also applies for an arrangement between two sections of the optical fibre.

With the suggested arrangement and associated method, an additional mechanism is provided for improving the safety of an opto-pyrotechnic initiator which in some designs uses purely passive components. Thus, this additional safety function is not dependent on an active actuation. Depending on the filter medium, reaction times less than 10 μs are possible, with the result that the ignition delay is not significantly prolonged by this additional safety function. The arrangement and the method can be implemented for all opto-pyrotechnic initiators in civilian and military applications.

The invention may be implemented particularly advantageously if at least two lasers are used, and serve together to deliver the energy required for initiation to the opto-pyrotechnic initiator, wherein, for example, the radiation from one is superimposed on the other at the initiating impingement location, or the two lasers are coupled into the same transport fibre to the initiator.

A high level of functional safety may be attained here with an independent actuation of the at least two lasers, but a problem arises in that the operation of one of the lasers as a consequence of a fault can be sufficient to ignite the initiator through prolonged action, even though the other lasers were not activated. This gap can now be closed through the use of the invention. To this end, the radiation from the at least two lasers is guided suitably in the filter element, for example by superimposing the two beams in an active volume of the filter element, so that the high transmission or reflection is only reached when both lasers emit high at the same time. This may be done using the same fibre or using separate fibres for each laser. If they are guided using the same fibre, the required overlap in the filter element occurs automatically. In this context, for example, fibres with multiple light-conducting cores may also be used in the same fibre mantle into which the different lasers are coupled.

BRIEF DESCRIPTION OF THE DRAWING

In the following text, the suggested arrangement and associated method will be explained again, in greater detail, with reference to exemplary embodiments in conjunction with the drawing. In the drawing.

WAYS OF IMPLEMENTING THE INVENTION

Figure 1:
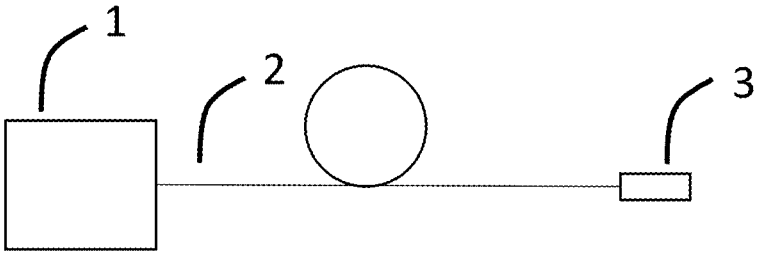
FIG. 1 shows a construction concept of the ignition chain of an arrangement with opto-pyrotechnic initiator.

An opto-pyrotechnic initiation system consists of an electronically actuated laser 1, in the present example in the form of a laser diode, an optical fibre 2 and the opto-pyrotechnic initiator 3, as is represented schematically in FIG. 1. The opto-pyrotechnic initiator 3 ignites a pyrotechnic mixture, which provokes a corresponding pyrotechnic effect after the initiation. In principle, this may be an optical (light, mist, smoke), an acoustic (sound), a thermal or a mechanical (pressure, motion) effect or combinations thereof.

With the suggested arrangement and associated method, safety when using an opto-pyrotechnic initiation system is improved with an additional safety mechanism. For this purpose, an optical filter element is introduced into the optical segment between the laser 1 and the initiating impingement location of the laser radiation in the opto-pyrotechnic initiator 3, which element has a power-dependent or intensity-dependent transmission or reflection.

Figure 2:
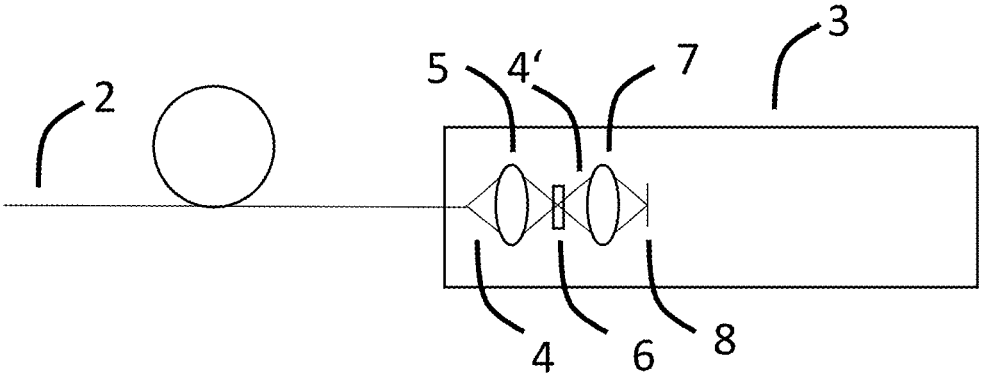
FIG. 2 shows a first example of a design of the suggested arrangement (partial view)

For this purpose, FIG. 2 shows a schematic representation of a first exemplary embodiment, in which only a part of the ignition chain is shown. In this example, the optical filter element 6 is arranged inside the opto-pyrotechnic initiator 3. The laser radiation 4 exiting the optical fibre 2 is focused into the filter element 6 via an optical system 5. The non-linear transmission function of the filter, i.e. for example the laser power threshold of the laser diode above which transmission increases significantly, is adjusted by the selection of the focal diameter in the filter element 6. The laser radiation 4' transmitted through the filter element 6 is directed, in particular focused via a further optical system 7 on the surface 8 that is sensitive for the optical initiation. Optical systems 5 and 7 represent the beam guidance. In this patent application, the point of incidence of the laser radiation on this surface is called the initiating impingement location. The desired level of safety is achieved by appropriate selection of focal diameter in the filter element 6 and the original transmission of the medium of the filter element 6 at low power or intensity, set for example by the doping or length of a saturable absorber as filter element 6. Focal diameter and transmission at lower laser power are adjusted in such a way that, firstly with a laser power of the laser diode at which initiation is not to take place, the aforementioned threshold is not reached in the filter element and the power that reaches the surface 8 remains reliably, i.e. even during extended irradiation, below the desired ignition threshold or is lowered to below said ignition threshold by the low transmission of the filter element 6. Secondly, the focal diameter is selected such that the abovementioned threshold in the filter element is exceeded with a laser power at which initiation is to take place. If a reflecting instead of a transmitting filter element is used, the laser beam is reflected at this element, wherein the laser radiation 4' in FIG. 2 is then equivalent to the reflected radiation.

Figure 3:
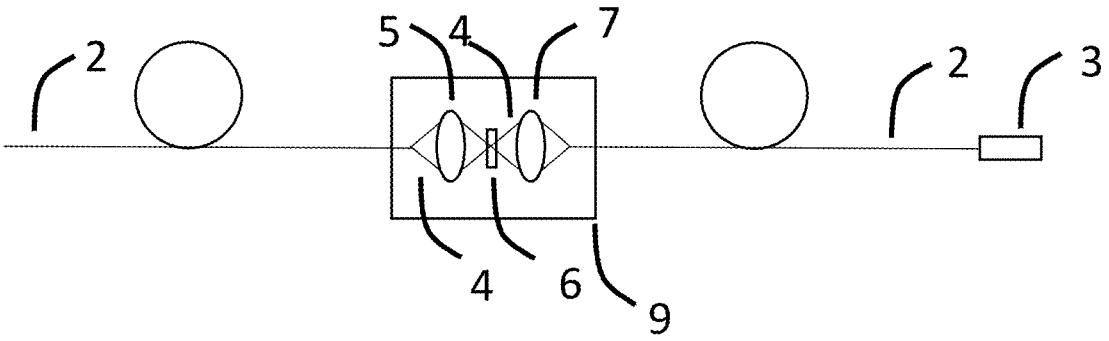
FIG. 3 shows a second example of a design of the suggested arrangement (partial view)

In a further exemplary embodiment, the filter element 6 is inserted in the optical fibre 2 in a stand-alone component 9, as indicated schematically in FIG. 3. FIG. 3 also shows only a part of the ignition chain. This arrangement inside the optical fibre 2 decouples any heating of the filter element 6 from the opto-pyrotechnic initiator 3 in the event of a malfunction, thus further increasing the functional safety of the ignition chain. Here too, the laser radiation is again focused on the optical filter element 6, and then collimated or focused for subsequent guidance in the optical fibre 2.

Figure 4:
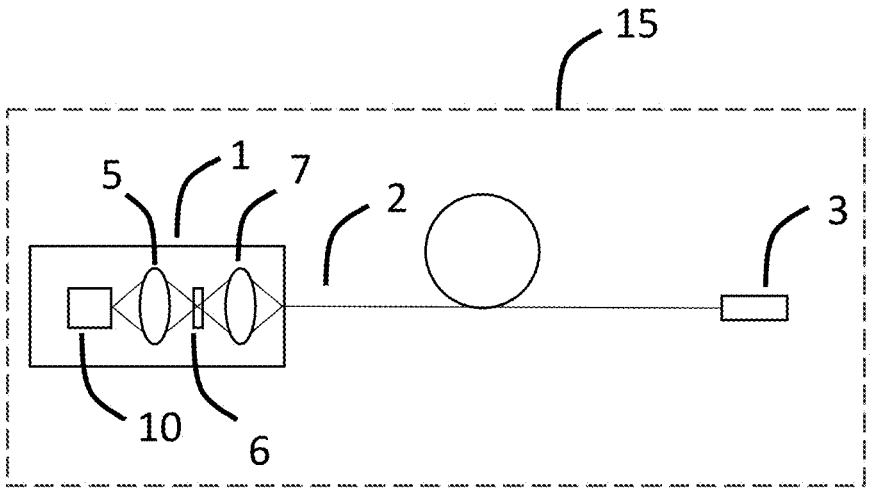
FIG. 4 shows a third example of a design of the suggested arrangement.

In a further exemplary embodiment of the apparatus 15, as represented schematically in FIG. 4, the filter component with the optical filter element 6 is arranged in the housing of the laser 1 between the laser-active material 10 situated in said housing, for example (in the housing) of a semiconductor laser, and the optical fibre 2. This minimises the number of fibre couplings, and accordingly increases the robustness of the system. Here too, the laser radiation is focused into the filter element 6 via two optical systems 5, 7, representing the beam guidance and is then collimated or also focused for subsequent guidance of the laser radiation.

Figure 5:
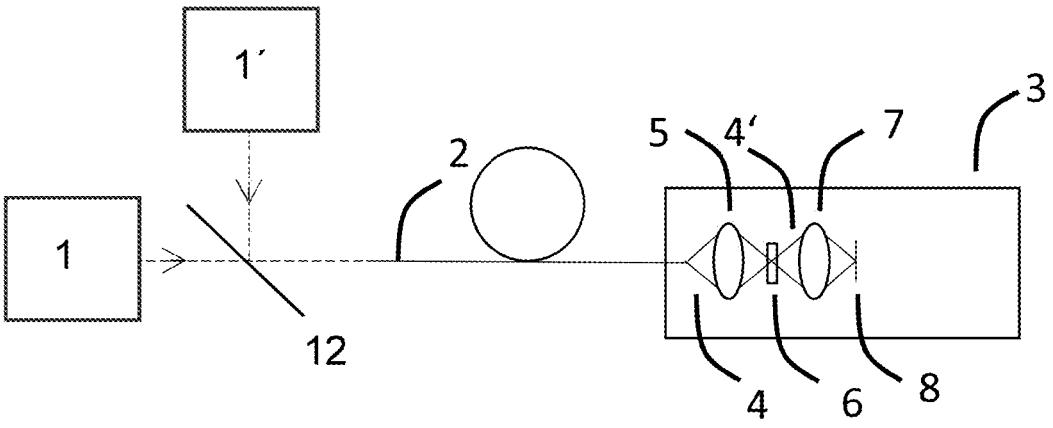
FIG. 5 shows a fourth example of a design of the suggested arrangement.

FIG. 5 illustrates an embodiment in which on the one hand a further laser 1' is coupled via a beam combiner 12 into the filter element 6, so that the laser radiation of both lasers 1, 1' is superimposed in the filter element 6.

Figure 6:
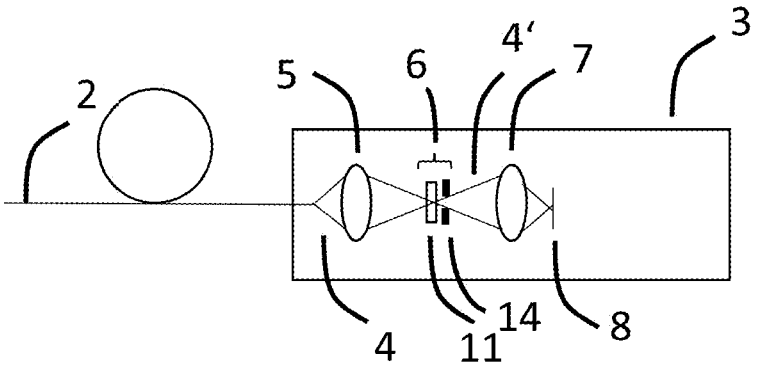
FIG. 6 shows a fifth example of a design of the suggested arrangement.

FIG. 6 illustrates an embodiment in which the optical filter element 6 is formed by a combination of an optically non-linear medium 11 that has power-dependent or intensity-dependent focusing or defocusing properties, with a following shutter 14 on the beam path of the laser radiation.

Figure 7:
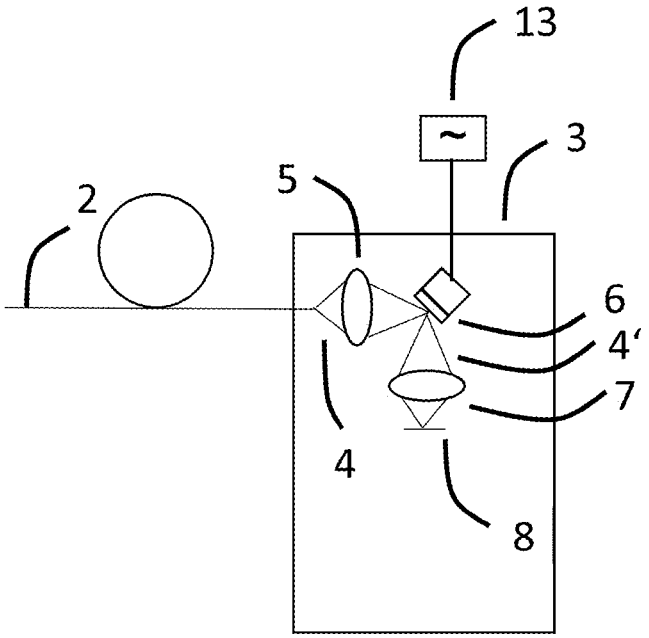
FIG. 7 shows a sixth example of a design of the suggested arrangement.

FIG. 7 illustrates an embodiment, in which optical filter element 6, in this case being a thin-film reflector includes a controllable device 13 for heating the thin-film reflector.

LIST OF REFERENCE NUMERALS

1 Laser
2 Optical fibre
3 Opto-pyrotechnic initiator
4 Laser radiation
4 Laser radiation after passing through filter element
5 Optical system
6 Filter element
7 Optical system
8 Surface sensitive for optical initiation
9 Component with filter element
10 Laser-active material
11 Optically non-linear medium
12 Beam combiner
13 Heating device
14 Shutter
15 Apparatus

The invention claimed is:

1. An apparatus comprising:

an opto-pyrotechnic initiator, in which a pyrotechnic mixture can be ignited by laser radiation;

at least one laser which emits the laser radiation; and an optical fibre, via which the laser radiation is guided to the opto-pyrotechnic initiator, wherein an optical filter element having power-dependent or intensity-dependent transmission or reflection for the laser radiation is arranged in a beam path of the laser radiation between the laser and an initiating impingement location of the laser radiation in the opto-pyrotechnic initiator, the filter element is selected, and a beam of the laser radiation is guided in such a way through the filter element that for a laser power of the at least one laser by which an initiation is to be effected in the opto-pyrotechnic initiator in the arrangement, the filter element has a higher transmission or reflection, or can be switched to a higher transmission or reflection by applying an optical signal or an electronic signal that is independent of the laser radiation than at a lower laser power, and the filter element has a power-dependent or intensity-dependent transmission and includes a saturable absorber.

2. An apparatus comprising:

an opto-pyrotechnic initiator, in which a pyrotechnic mixture can be ignited by laser radiation;

at least one laser which emits the laser radiation; and an optical fibre, via which the laser radiation is guided to the opto-pyrotechnic initiator, wherein an optical filter element having power-dependent or intensity-dependent transmission or reflection for the laser radiation is arranged in a beam path of the laser radiation between the laser and an initiating impingement location of the laser radiation in the opto-pyrotechnic initiator, the filter element is selected, and a beam of the laser radiation is guided in such a way through the filter element that for a laser power of the at least one laser by which an initiation is to be effected in the opto-pyrotechnic initiator in the arrangement, the filter element has a higher transmission or reflection, or can be switched to a higher transmission or reflection by applying an optical signal or an electronic signal that is independent of the laser radiation than at a lower laser power, wherein the optical signal is laser radiation from at least one further laser, which is coupled into the filter element in such a way that the higher transmission or reflection with the laser power of the at least one laser required to effect the initiation is only attained by superimposing the laser radiation of the at least one laser with the laser radiation of the at least one further laser in the filter element.

3. The apparatus according to claim 2, wherein laser beams emitted by the lasers are superimposed at least in the opto-pyrotechnic initiator.

4. An apparatus comprising:

an opto-pyrotechnic initiator, in which a pyrotechnic mixture can be ignited by laser radiation;

at least one laser which emits the laser radiation; and an optical fibre, via which the laser radiation is guided to the opto-pyrotechnic initiator, wherein an optical filter element having power-dependent or intensity-dependent transmission or reflection for the laser radiation is arranged in a beam path of the laser radiation between the laser and an initiating impingement location of the laser radiation in the opto-pyrotechnic initiator, the filter element is selected, and a beam of the laser radiation is guided in such a way through the filter element that for a laser power of the at least one laser by which an initiation is to be effected in the opto-pyrotechnic initiator in the arrangement, the filter element has a higher transmission or reflection, or can be switched to a higher transmission or reflection by applying an optical signal or an electronic signal that is independent of the laser radiation than at a lower laser power, wherein the optical filter element includes a combination of an optically non-linear medium that has power-dependent or intensity-dependent focusing or defocusing properties, and a following shutter on the beam path of the laser radiation which allows the laser radiation to pass unobstructed only with focusing by means of the non-linear medium.

5. The apparatus according to claim 4, wherein the at least one laser includes a plurality of lasers configured to emit the laser radiation, wherein laser beams emitted by the lasers are superimposed at least in the opto-pyrotechnic initiator.

6. An apparatus comprising:

an opto-pyrotechnic initiator, in which a pyrotechnic mixture can be ignited by laser radiation;

at least one laser which emits the laser radiation; and an optical fibre, via which the laser radiation is guided to the opto-pyrotechnic initiator, wherein an optical filter element having power-dependent or intensity-dependent transmission or reflection for the laser radiation is arranged in a beam path of the laser radiation between the laser and an initiating impingement location of the laser radiation in the opto-pyrotechnic initiator, the filter element is selected, and a beam of the laser radiation is guided in such a way through the filter element that for a laser power of the at least one laser by which an initiation is to be effected in the opto-pyrotechnic initiator in the arrangement, the filter element has a higher transmission or reflection, or can be switched to a higher transmission or reflection by applying an optical signal or an electronic signal that is independent of the laser radiation than at a lower laser power, wherein the optical filter element includes a thin-film reflector, whose reflectivity changes thermally by a phase transition.

7. The apparatus according to claim 6, wherein the optical filter element includes a controllable device for heating the thin-film reflector.

8. The apparatus according to claim 6, wherein the at least one laser includes a plurality of lasers configured to emit the laser radiation, wherein laser beams emitted by the lasers are superimposed at least in the opto-pyrotechnic initiator.

9. The apparatus according to claim 1, wherein the at least one laser includes a plurality of lasers configured to emit the laser radiation, wherein laser beams emitted by the lasers are superimposed at least in the opto-pyrotechnic initiator.

10. The apparatus according to claim 1, wherein the laser radiation is focused onto or into the optical filter element through an optical system.

11. The apparatus according to claim 1, wherein the filter element is arranged in the opto-pyrotechnic initiator or between the optical fibre and the opto-pyrotechnic initiator.

12. The apparatus according to claim 1, wherein the filter element is arranged inside a housing for the at least one laser or between the at least one laser and the optical fibre.

13. The apparatus according to claim 1, wherein the filter element is inserted in the optical fibre.

14. The apparatus according to claim 1, wherein the laser is a semiconductor laser.

* * * * *